US005192631A

United States Patent [19]

Inoue et al.

[11] Patent Number: 5,192,631

[45] Date of Patent: Mar. 9, 1993

[54] VARIABLE ELECTROCONDUCTIVITY MATERIAL

[75] Inventors: Eiichi Inoue, Setagaya; Atsumi Noshiro, Chiba; Minoru Utsumi, Yokohama, all of Japan

[73] Assignee: Dai Nippon Insatsu Kabushiki Kaisha, Japan

[21] Appl. No.: 594,026

[22] Filed: Oct. 9, 1990

Related U.S. Application Data

[62] Division of Ser. No. 274,938, Jan. 4, 1989, Pat. No. 4,997,593.

[30] Foreign Application Priority Data

Mar. 18, 1987 [JP] Japan ..... 62-61350
Mar. 17, 1988 [WO] PCT Int'l Appl. ... PCT/JP88/00277

[51] Int. Cl.[5] ..... G03G 5/06

[52] U.S. Cl. ..... 430/56; 430/945; 313/523; 346/76 PH; 346/76 L; 338/14; 338/15; 252/518; 252/520; 428/913; 365/108; 365/112

[58] Field of Search ..... 428/913; 430/56; 252/500, 58; 365/107, 108

[56] References Cited

U.S. PATENT DOCUMENTS

| | | | |
|---|---|---|---|
| 3,958,207 | 5/1976 | Tutehasi | 338/15 |
| 4,148,968 | 4/1979 | Nagashima et al. | 428/500 |
| 4,172,180 | 10/1979 | Takeda | 252/500 X |
| 4,281,053 | 7/1981 | Tang | 430/58 |
| 4,338,222 | 7/1982 | Limburg et al. | 430/59 |
| 4,346,157 | 8/1982 | Kakuta | 430/59 |
| 4,353,971 | 10/1982 | Chang et al. | 430/56 |
| 4,557,856 | 12/1985 | Miyakawa et al. | 430/56 |
| 4,745,301 | 5/1988 | Michalchik | 338/99 X |
| 4,780,790 | 10/1988 | Takimoto et al. | 338/205 X |
| 4,997,593 | 3/1991 | Inoue et al. | 430/58 X |

*Primary Examiner*—Roland Martin
*Attorney, Agent, or Firm*—Parkhurst, Wendel & Rossi

[57] ABSTRACT

A variable electroconductivity material characterized by being obtained by formulating (a) an electroconductivity variation imparting agent comprising a substance which is caused by light or heat energy to undergo structural change, reversibly or irreversibly, between nonionic and ionic structures and (b) a charge transport substance the electroconductivity of which is varied by said structural change of said electroconductivity variation imparting agent, and an information recording medium obtained by the use of this material has excellent memory stability, and also a light (heat) converting device having conversion characteristics can be obtained by the use of this material.

10 Claims, 4 Drawing Sheets

VARIABLE ELECTROCONDUCTIVITY MATERIAL

This application is a Rule 60 Divisional application Ser. No. 07/274,938 filed Jan. 4, 1989, now U.S. Pat. No. 4,997,593.

TECHNICAL FIELD

This invention relates to a material having a variable electroconductivity and more particularly to a material the electroconductivity of which can be reversibly or irreversibly varied by application of light or heat energy thereto and also to a method for utilizing the same.

BACKGROUND ART

As one of the methods for making certain information contained in a memory medium obtainable, there is known the method of utilizing memorizable electroconductivity variation. According to this method, by effecting exposure corresponding to recording information on a specific photosensitive material, electroconductivity variation having memorizability is created at the exposed portion, and the recorded information can be visualized by, for example, various developing methods employed for electrostatic photography. Also, such photosensitive material which brings about memorizable electroconductivity variation by light may be considered for uses as an optical forming memorizable electroconductive circuit or an optical switching device, since the current flowing through the photosensitive material varies under the voltage applied state.

In the prior art, various memorizable photosensitive materials have been proposed for electrostatic photography (for example, U.S. Pat. Nos. 3,879,201 and 3,997,342).

However, in the memorizable photosensitive materials of the prior art, for obtaining a desired image, there are problems such as that the exposure dosage must be made relatively larger (10 mJ/cm$^2$ to 100 mJ/cm$^2$), and also that the time in which the memory effect is stably maintained is short (some 10 minutes to about 1 hour).

In view of the problems of the prior art, I have proposed various improvement techniques for the purpose of improving particularly exposure sensitivity (for example, Japanese Patent Application No. 167010/1977, Japanese Laid-Open Patent Publication No. 17358/1981, Japanese Patent Application No. 5233/1982). However, in this prior art, a sufficiently improved characteristic can be obtained with respect to exposure sensitivity, but there is the problem that memory stability is not yet sufficiently satisfactory.

On the other hand, various materials which undergo nonmemorizable electroconductivity variation have been known and utilized as optical switching devices or optical sensors. However, the converting devices of the prior art as mentioned above, while undergoing electroconductivity variation between ON-OFF changes in the relatively lower electroconductivity region, are not sufficiently satisfactory with respect to their switching sensitivity.

DISCLOSURE OF THE INVENTION

The present invention has been accomplished in view of the points as described above, and particularly the following points are objects of the invention.

(a) To provide a material having excellent electroconductivity variation characteristic with respect to the application of light or heat energy.

(b) To provide a memorizable recording material with excellent memory stability having the above material, and a recording-reproducing method by use of the recording material (c) To provide a non-memorizable converting device with excellent converting characteristic having the above material, and a detecting method by use of the converting device.

The variable electroconductivity material according to the first form of the present invention comprises a formulation of (a) an electroconductivity variation imparting agent comprising a substance which undergoes structural change between nonionic and ionic structures, reversibly or irreversibly, by light or heat energy and (b) a charge transport substance which is changed in electroconductivity by the structural change of said electroconductivity variation imparting agent.

The memorizable recording material according to the second form of the present invention comprises a memorizable converting layer obtained by formulating (a) an electroconductivity variation imparting agent comprising a substance which undergoes structural change between nonionic and ionic structures, reversibly or irreversibly, by light or heat energy and (b) a charge transport substance which is changed in electroconductivity by the structural change of said electroconductivity variation imparting agent formed on an electrode material.

The recording-reproducing method according to the third form of the present invention comprises performing information recording on the converting layer of the above memorizable recording material by applying light or heat energy corresponding to the recording information, and further detecting the information thus memorized electrically or/and optically.

The non-memorizable converting device according to the fourth form of the present invention comprises a non-memorizable converting layer obtained by formulating (a) an electroconductivity variation imparting agent comprising a substance which undergoes structural change between nonionic and ionic structures, reversibly or irreversibly, by light or heat energy and (b) a charge transport substance which is changed in electroconductivity by the structural change of said electroconductivity variation imparting agent formed between a pair of electrode materials.

Furthermore, the detecting method according to the fifth form of the present invention comprises applying light or heat energy to the converting layer of the above non-memorizable converting device, and detecting the electroconductivity variation in the converting layer caused to occur thereby.

BEST MODES FOR PRACTICING THE INVENTION

Figure 1:
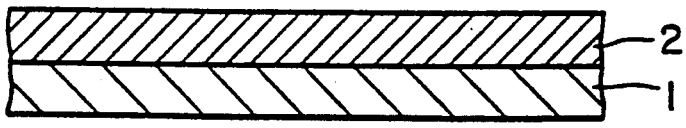
FIG. 1 to FIG. 3 and FIG. 5 are sectional views of the recording material according to the present invention.

In the following, the present invention as summarized above is described in more detail.

Variable electroconductivity material

The variable electroconductivity material according to the present invention is obtained by formulating a charge transport substance and an electroconductivity variation imparting agent.

Charge transport substance

As the charge transport substance, a high molecular weight photoconductor itself, or a dispersion of a low molecular weight photoconductor in an insulating binder or a high molecular weight conductor or a low molecular weight conductor can be used. As such a high molecular weight photoconductor, other than polyvinylcarbazole, there can be used poly-N-ethylenically unsaturated group-substituted carbazoles which are polymers of N-substituted carbazole containing ethylenically unsaturated group such as allyl group, acryloxyalkyl group, etc. in place of vinyl group, poly-N-ethylenically saturated group-substituted phenothiazines such as poly-N-acrylphenothiazine, poly-N-(β-acryloxy)phenothiazine, etc., polyvinylpyrene, etc. Among them, poly-N-ethylenically unsaturated group-substituted carbazoles, particularly polyvinylcarbazole, is preferably used. Further, together with these an insulating binder resin such as silicone resin, styrene-butadiene copolymer resin, saturated or unsaturated polyester resin, polycarbonate resin, polyvinyl acetal resin, etc. can be combined and used as the film forming charge transport substance.

As the low molecular weight photoconductor, oxodiazoles, hydrazones, pyrazolines, triphenylmethane derivatives, etc. substituted with alkylaminophenyl group, etc. can be used. These low molecular weight photoconductors can be used as the film forming charge transport substance by combining, per one part thereof with for example about 1 to 10 parts of an insulating binder resin such as silicone resin, styrene-butadiene copolymer resin, saturated or unsaturated polyester resin, polycarbonate resin, polyvinyl acetal resin, etc.

Furthermore, as the charge transport substance, an inorganic photoconductive material such as ZnO, $TiO_2$ and CdS can be also used. These inorganic photocoductives can be formed into a film by dispersing one part thereof into 0.1 to 1 part of an insulating binder.

In the present invention, the above charge transport substance has the action of changing electroconductivity by the structural change of the electroconductivity variation imparting agent as described hereinafter. Accordingly, when attention is called on the physical properties, so long as the above action is possessed, as the charge transport substance in the present invention, organic compound and/or inorganic compounds having a specific resistivity within the range of $10^{-3}$ to $10^{18}$ Ω·cm is preferably employed.

For example, as the substance having a specific resistivity of $10^{17}$ Ω·cm or higher, there are polyvinylcarbazole or lower molecular weight photoconductors, and further, phthalocyanine compounds of $10^{17}$ to $10^{11}$ Ω·cm, polyacetylene of $10^{11}$ to $10^{4}$ Ω·cm, perylene compounds of $10^{4}$ to 10 Ω·cm, TTF-TCNQ complexes of 10 to $10^{-3}$ Ω·cm, etc. can be used.

Also, in the present invention, materials other than photoconductors can be used as the charge transport substance.

As such charge transport substance, there can be used n-conjugated type polymers, charge transfer polymer complexes, charge transfer complexes, metal complex polymers in the range of $10^{-5}$ to $10^{14}$ Ω·cm. As the n-conjugated type polymers, there can be used polyacetylene, polydiacetylerine, poly(P-phenylene), poly(P-phenylenesulfide), poly(P-phenyleneoxide), poly(1,6-heptadiene), poly(P-phenylenevinylene), poly(2,5-thienylene), poly(2,5-pyrrole), poly(m-phenylenesulfide), poly(4,4'-biphenylene); and as the charge transfer polymer complexes, (polystyrene) $AgClO_4$, (polyvinylnaphthalene) TCNE, (polyvinylnaphthalene) P-CA, (polyvinylnaphthalene) DDQ, (polyvinylmesitylene) TCNE, (polyacenaphthalene) TCNE, (polyvinylanthracene) $Br_2$, (polyvinylanthracene) $I_2$, (polyvinylanthracene) TNB, (polydimethylaminostyrene) CA, (polyvinylimidazole) CQ, (2-vinylpyridine) CQ, (poly-P-phenylene) $I_2$, (poly-1-vinylpyridine) $I_2$, (poly-4-vinylpyridine) $I_2$, (poly-P-1-phenylene) $I_2$, (polyvinylpyridium) TCNQ. As the low molecular weight charge transfer complex, TCNQ-TTF, etc., are employed, and as the metal complex polymer, polycopper phthalocyanine, etc.

Figure 8A:
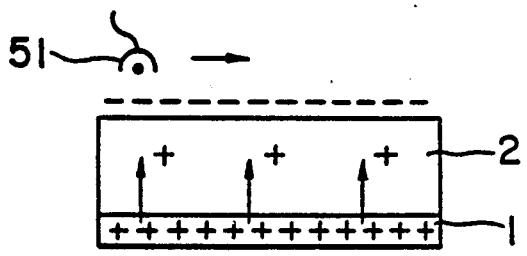
Figure 8B:
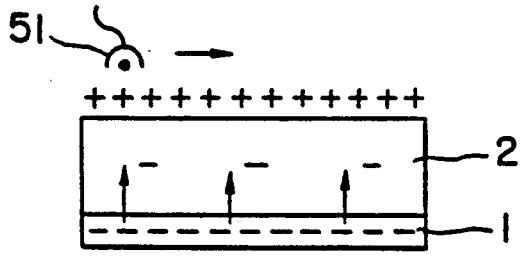

In the present invention, the charge transport substance may have either the positive hole or electron having the transport ability. As shown in FIG. 8, when the charge transport substance in the converting layer 2 is a hole transport material, reading for, for example, corona charging, (−) polarity is used (FIG. 8(*a*)); on the contrary, in the case of an electron transport material; (+) polarity is used (FIG. 8(*b*)).

Electroconductivity variation imparting agent

The electroconductivity variation imparting agent comprises a substance which undergoes a reversible or irreversible change between nonionic and ionic structures by light or heat energy. Specifically, spiropyrane compounds represented by the formulae shown below and derivatives thereof can be preferably used.

1

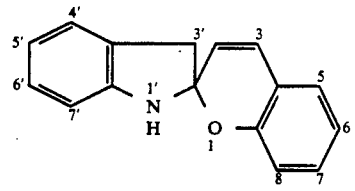

2

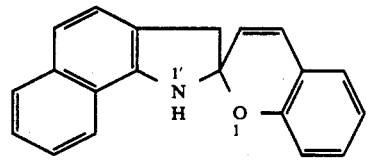

3

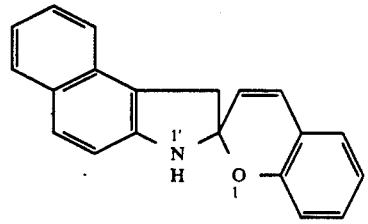

-continued
4
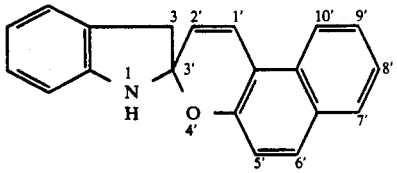
5
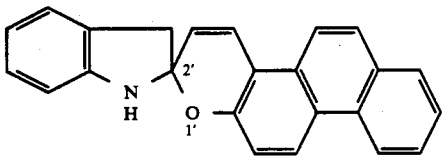
6
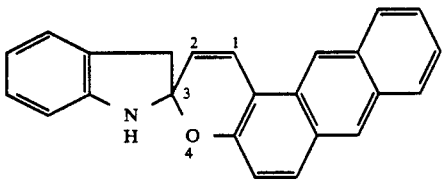
7
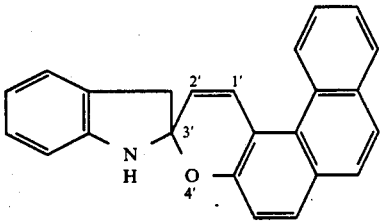
8
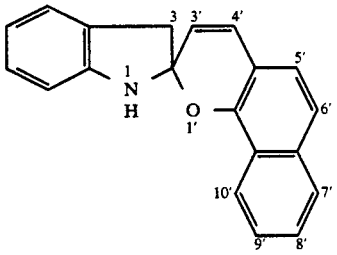
9
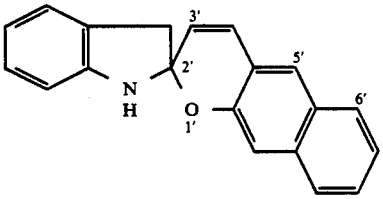
10
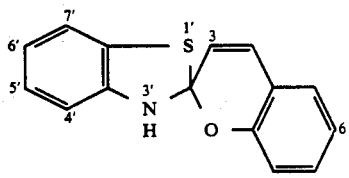
-continued
11
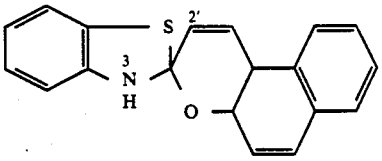
12
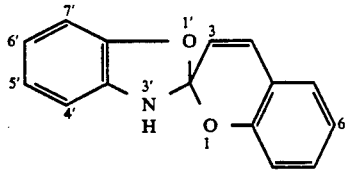
13
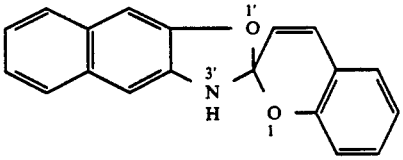
14
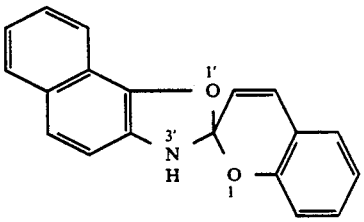
15
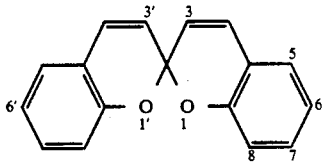
16
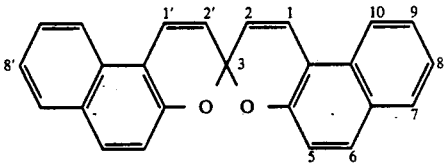
17
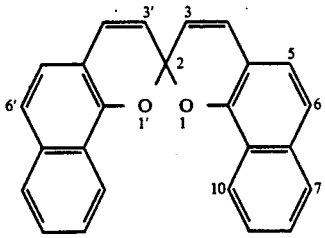
18
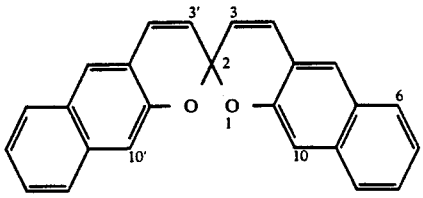

-continued
19
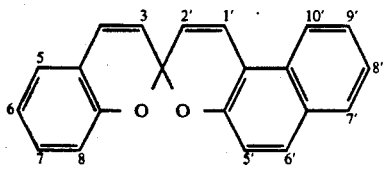
20
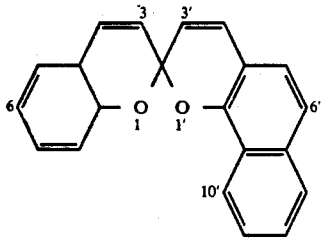
21
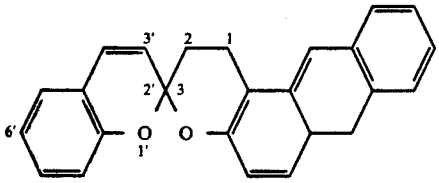
22
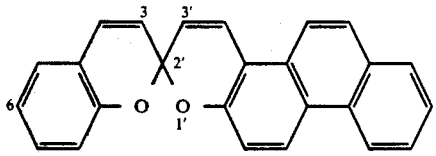
23
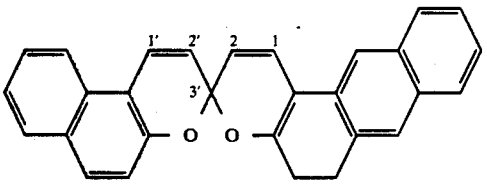
24
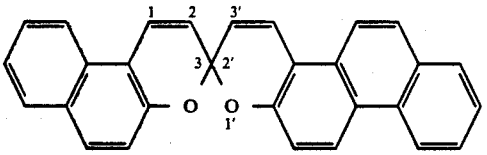
25
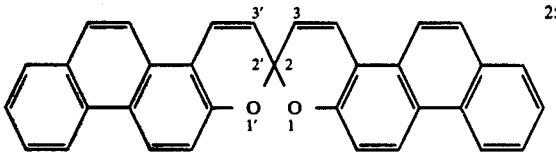
26
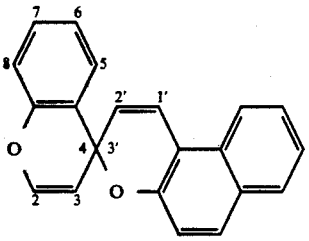
-continued
27
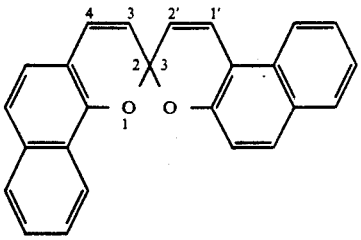
28
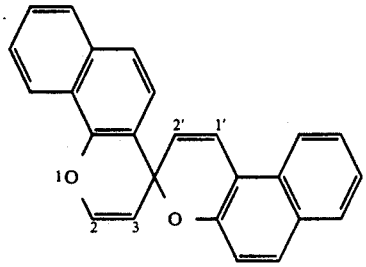
29
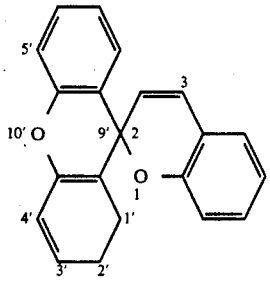
30
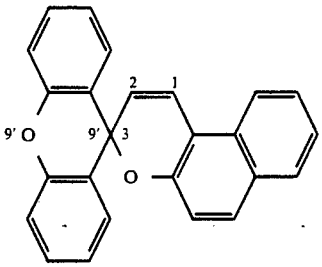
31
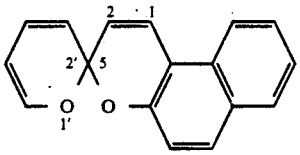
32
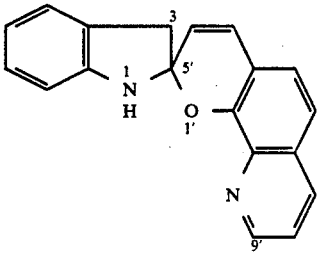

-continued
33
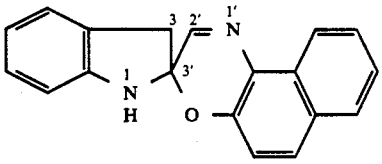
34
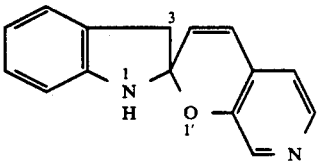
35
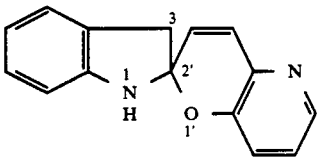
36
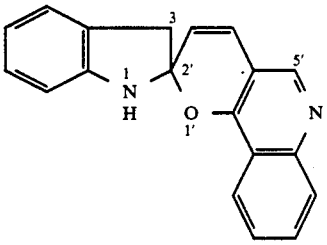
37
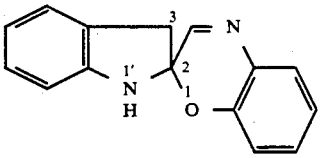
38
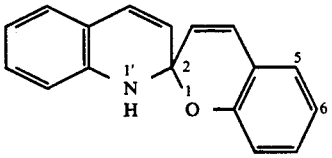
39
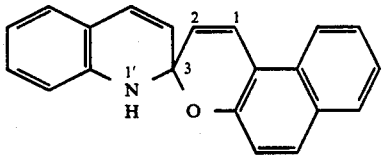
40
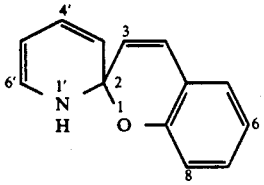
-continued
41
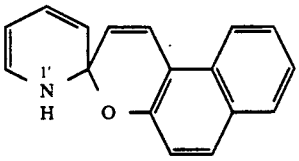
42
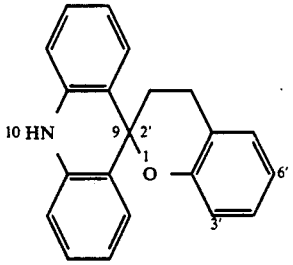
43
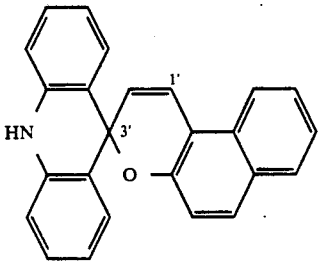
44
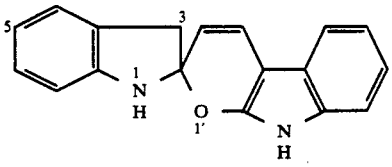
45
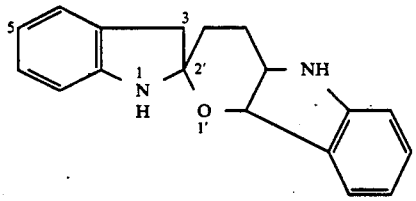
46
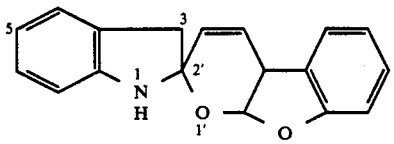
47
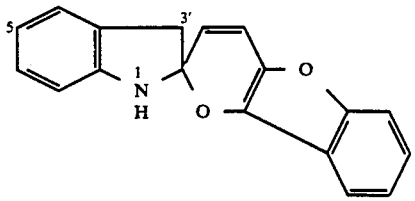

-continued

48

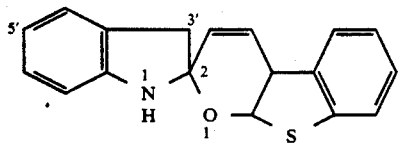

49

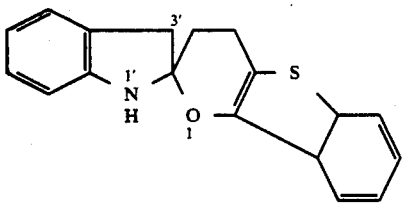

50

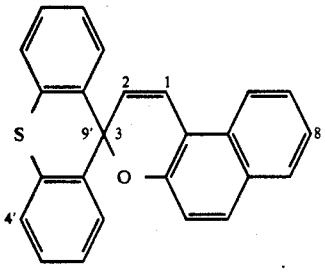

51

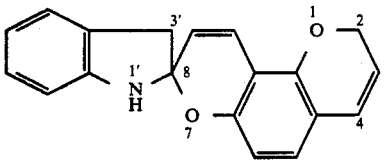

52

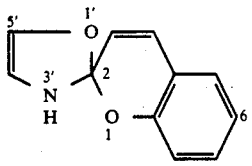

53

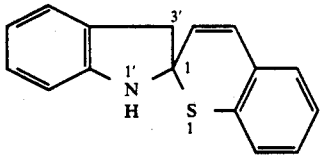

54

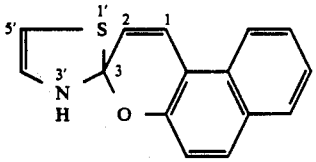

55

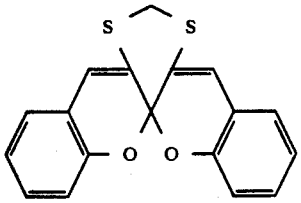

-continued

56

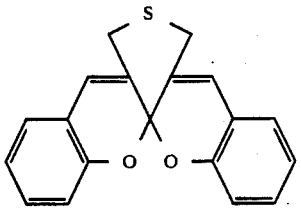

57

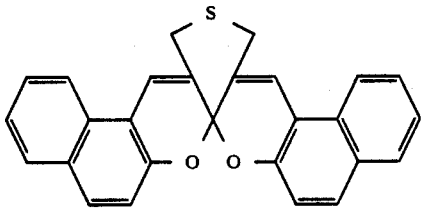

58

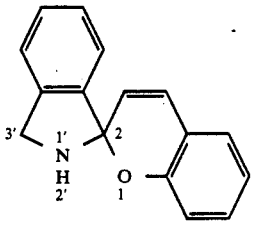

59

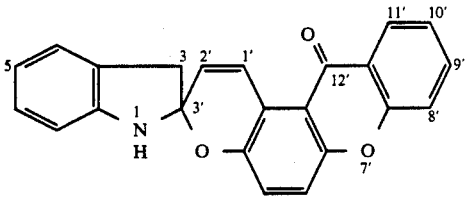

60

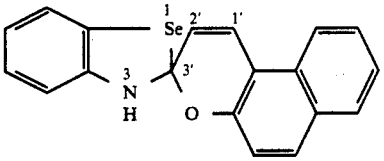

In the above formulae, the numerals in the formulae represent the positions of the substituents, and compounds having methyl, ethyl, propyl, butyl, methoxy, ethoxy, hydroxy, carboxyl group or a halogen, etc. as the substituents for hydrogen can be also used. The above spiropyrane compounds include stable compounds (having memorizability) under the ring-opened state namely under the ionic state, and also stable compounds (having memorizability) under the ring-closed state, namely under the nonionic state.

The above spiropyrane compounds are substances which undergo reversible structural change between ionic and nonionic structures substantially by the action of light energy (reversible photochromic material), and among them compounds of the formulae 1, 10, 16, 19, 30, 41, 42, 60 or derivatives thereof can undergo reversible structural change between ion and nonionic structures by the action of heat energy. Specifically, they are compounds having the substituents as shown below.

Compounds of formula 1:

6-bromo-1',3',3'-trimethyl 5,7-dichloro-6-nitro-1',3',3'-trimethyl

5'-methoxy-1',3',3'-trimethyl-6-methoxy-1',3',3'-trimethyl
7-methoxy-1',3',3'-trimethyl
5'-methoxy-6-nitro-1',3',3'-trimethyl
6-nitro-1',3',3'-trimethyl
Compounds of formula 10:
7'-methoxy
3,3'-dimethyl-5'-methacrylamino-6-nitro
Compounds of formula 16:
2-methoxy
2-isopropyl
2-phenyl
2,2'-dimethyl
2,2'-dimethylene
Compounds of formula 41:
1'-ethyl
Compounds of formula 42:
1'-methyl
Compounds of formula 60:
1,3,3-trimethyl
5'-methoxy-1,3,3-trimethyl Also, substances which undergo irreversible structural change from ionic to nonionic structure by the action of light or heat energy can be used as the electroconductivity variation imparting agent. Specifically, the diazoniums compounds as shown below can be used.

(a) P-phenylenediamines
p-diazomethylaniline
p-diazo-N,N-dimethylaniline
p-diazo-N,N-diethylaniline
p-diazo-N-β-hydroxydiethylaniline
4-diazo-2-iodo-N-methyl-N-phenylethylaniline
4-diazo-5-chloro-2-methoxy-N-ethyl-N-benzylaniline
4-diazo-N-ethyl-N-β-phenylethylaniline
(b) aminohydroquinone ethers
4-diazo-2,5-dibutoxy-N,N'-diethylaniline
4-diazo-2,5-dibutoxy-N,N-diethylaniline
4-diazo-2,5-diethoxy-N-benzylaniline
4-diazo-2,5-diethoxy-N,N-di-n-propylaniline
4-diazo-2,5-diethoxy-N-benzylaniline
4-diazo-2,5-diethoxy-N-ethyl-N-benzylaniline
(c) aminodiphenyls
p-diazodiphenylamine
4-diazo-4'-methoxydiphenylamine-4-diazo-3',6',4'-tribromodiphenylamine
4-diazo-2,5-diethoxyphenylethylsulfide
(d) heterocyclic amines
4-diazo-N-phenylmorpholine
4-diazo-N-phenyl-thiomorpholine
4-diazo-N-phenylpiperidine
4-diazo-N-phenylpyrrolidine
(e) o-phenylenediamines
2-diazo-5-benzoylamino-N,N-dimethylaniline
3-diazo-4-N,N-dimethylaminodiphenyl
2-diazo-4-bromo-N,N-dimethylaniline
2-diazo-4-methylmercapto-N,N-dimethylaniline
(f) o-aminophenols
1-dimethylaminomethyldiphenyleneoxide
3-pyperidylmethyl-5-methyl-1,2-benzoquinonediazide Also, substances which undergo irreversible structural change from nonionic to ionic structure can be used as the electroconductivity variation imparting agent. Specifically, the combinations of leuco dyes and halide compounds as shown below can be used.

(a) leuco dyes
tri(N-diethylaminophenyl)methane
tri(N-diethylaminophenyl)methane
p,p',p''-triaminotriphenylmethane
p,p'-tetramethyl-diaminodiphenylmethane
p,p',p''-triamino-o-methyltriphenylmethane
p,p',p''-triaminotriphenylcarbinol
(b) halogen compounds
N-bromosuccimide
carbon tetrabromide
2-chloroanthraquinone
tetrabromo-o-cresol
N-chlorosuccimide
1,2,3,4-tetrabromobutane
1,2,3,5-tetrachlorobenzene
carbon tetrachloride
2,4-dichlorophenol
tetrachlorotetrahydronaphthalene
hexachlorobenzene
p-bromoacetanilide
hexachloroethane
p-dichlorobenzene In the present invention as described above, the electroconductivity variation imparting agent is a substance which undergoes structural change between ionic and nonionic structures, and in the nonionic structure, represents a substance which brings about increase in the electroconductivity of the material, and its structural change may be either reversible or irreversible.

In the material of the present invention, one having non-memorizable converting characteristics can be also obtained by selecting the electroconductivity variation imparting agent.

As the substance which induces such non-memorizable electroconductivity variation, spiropyrane compounds 61 to 69 as shown below can be used. In the compounds of 61 to 69, the substituent X is preferably a halogen.

61
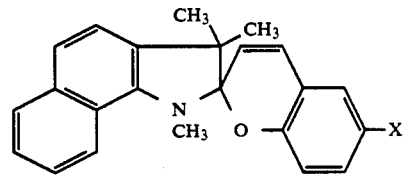

62
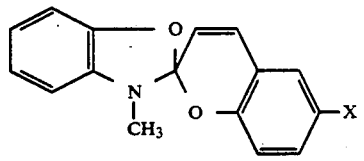

63
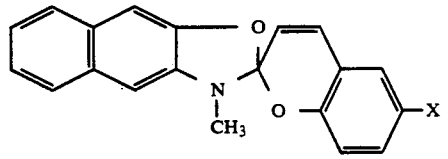

64
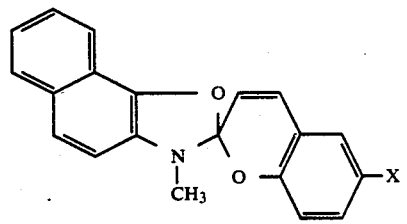

-continued

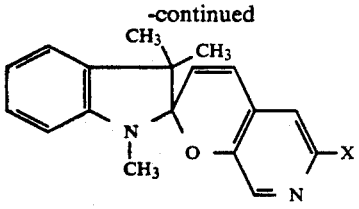

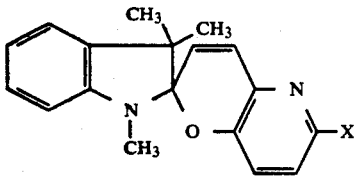

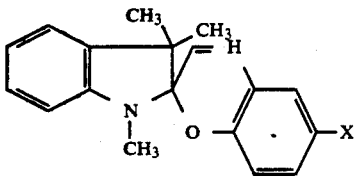

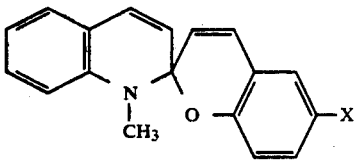

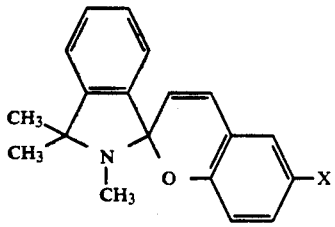

Furthermore, in the present invention, dyes having ionic structure can be also used as the electroconductivity variation imparting agent. As such dyes, for example, dyes of the diarylmethane type, the triarylmethane type, the thiazole type, the methine type, the xanthene type, the oxazine type, the thiazine type, the azine type, the acridine type, the azo type or the metal complex type may be preferably used. Specifically, the dyes as shown below can be used.

For example, Auramine, Auramine 0 as the diarylmethane type; Crystal Violet, Malachite Green, Victoria Blue, Methyl Violet, Diamond Green, 3,3-di(N-ethylcarbazoyl)phenylmethane $BF_4$ as the triarylmethane type; Thioflavine as the thiazole type; Astra-Floxin as the methane type; Rhodamine B, Rhodamine 6GCP as the xanthene type; Rhodeurine Blue as the oxazine type; Methylene Blue as the thiazine type; Safratonine T as the azine type; Acridine Orange as the acridine type; Bismark Brown as the azo type; and Irgalan Brown Violet DL, Perlonechviolett RTS as the metal complex dye are preferably used.

Formulation

The respective blending proportions of the components can be selected according to the components added, the function to be obtained and the use, but generally it is preferable to formulate an electroconductivity variation imparting agent in an amount of 0.0001 to 1 mole per mole of a charge transport substance (in the case of a polymer, per 1 mole of the polymer units).

The variable electroconductivity material of the present invention is basically obtained by formulating a charge transport substance and an electroconductivity variation imparting agent, but in the present invention, in addition to the case when the variable electroconductivity material is a composition, there is also included the case when a specific compound (including polymer) is formed by the reaction between the above respective formulation components.

Memorizable recording material

As shown in the sectional view in FIG. 1, the memorizable recording material formed by the use of the material according to the present invention comprises a converting layer 2 formed on an electrode material 1.

Electrode material

The electrode material 1 generally comprises an electroconductive substrate. Such a material not only acts as a mere electrode, but also plays an important role as one of the constituents of the material, and it is necessary that hole injection into the converting layer be possible. In this respect, Al which is the electroconductive substrate material most generally employed as a conventional electrophotographic material is inconvenient because a film immobilized by oxidation is formed on the surface to act as a barrier against hole injection.

Figure 2:
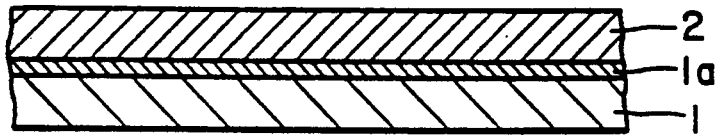

As such an electrode material 1, preferably an electroconductive material single substance, or as shown in FIG. 2, one having a film la of an electroconductive material formed on a sheet of glass or transparent plastic such as polyester, polycarbonate, etc. or the electrode material 1 is employed. As the electroconductive, a metal or semiconductor element such as Zn, Ti, Au, Ag, Fe, Sn, Cu, In, etc., or an oxide semiconductor such as $SnO_2$, $In_2O_3$, ZnO, TiO, NiO, WO, $V_2O_5$, etc. which can give a surface resistivity of $10^2$ to $10^6$ Ω/□ stably is preferably used either singly or as a composite material of two or more kinds.

In the case where the electroconductivity variation imparting agent is a dye, the above electrode material can be applied, while where the electroconductivity variation imparting agent is a spiropyrane compound, diazonium compounds or derivatives of these, and a combination of leuco dyes and halide compounds, etc. of the above electrode materials, the so-called ohmic electrode having no control of the rate of charge injection into the converting layer is desirable. As the material which can become electrode material exhibiting such ohmic property, a metal or semiconductor element such as Au, Ag, Cu, Zn, Ti, Ag, Fe, Sn, Cu, or In, is employed, and among them Au electrode is desirably employed as the complete ohmic electrode.

Converting layer

The memorizable converting layer 2 comprises a material obtained by formulating the charge transport substance and the electroconductivity variation imparting agent as described above.

For example, when applied to a memorizable recording material to be used for the electrostatic method, a combination of a charge transport substance of $10^{12}$ Ω·cm or higher and a memorizable electroconductivity variation imparting agent is preferably used.

On the other hand, when applied to a memorizable recording material which performs electrical detection such as memorizable switching device or memorizable sensor, a combination of a charge transport substance of $10^{-5}$ to $10^{18}$ Ω·cm and a memorizable electroconductivity variation imparting agent is preferably used.

Also, for increasing the adhesiveness with an electrode as well as increasing the film strength, it is possible to add an insulating binder resin such as saturated or unsaturated polyester, polycarbonate resin, polyvinyl acetal resin, styrene-butadiene copolymer resin, or silicone resin, as the binder.

The electroconductivity variation imparting agent is formulated in an amount of 0.0001 to 1 mole per one mole of the charge transport substance (in the case of a polymer, per 1 mole of the polymer units), and the formulation is diluted with a solvent, if necessary, and coated by use of a wire bar, doctor blade, etc. to obtain a converting layer. The converting layer should desirably have a film thickness of 1 to 30 μm.

Figure 3:
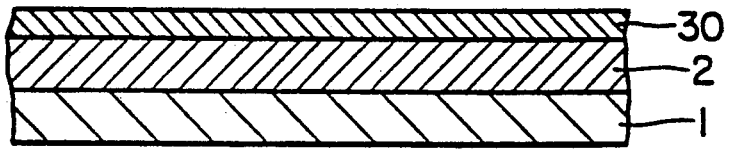

Also, in the present invention, as shown in FIG. 3, on the surface of the converting layer 2 can be further laminated a relatively thin charge transport layer 30 having no converting effect to provide a lamination type recording material.

As the material for such charge transport layer 30, organic photoconductive polymers, typically PVK, dispersions of organic low molecular weight compounds such as oxadiazole, hydrazone, and pyrazoline in a binder is employed, and it can be formed by coating these by spinner coating by use of a wire bar, doctor blade, etc.

In the recording material of the present invention, the reason why the change or variation in electroconductivity occurs by imparting light or heat energy has not necessarily been clarified. However, for example, when considering the case of increasing electroconductivity of the converting layer by causing a structural change from ionic to nonionic structure by imparting light energy as the electroconductivity variation imparting agent having memorizability, it may be estimated as follows. FIGS. 6(*a*) to (*d*) are conceptional views representing the process in this case. More specifically, the charge transport substance is a p-type semiconductor having a great hole mobility. In the converting layer 2 containing the electroconductivity variation imparting agent ($A^{+-}$) added in these materials, the electroconductivity variation imparting agent functions as the trapping agent of hole, whereby lowering of the dark electroconductivity is caused to occur. That is, into the converting layer 2 are generally generated holes from the electroconductive material (electrode material) 1, and the holes injected repeat trapping and detrapping, whereby lowering in mobility will occur as a practical effect. When a light in the absorption wavelength region of the electroconductivity variation imparting agent is irradiated through, for example, a mask 50 on the converting layer 2 having such characteristics, through the photochemical reaction of the electroconductivity variation imparting agent, the irradiated portion changes from the ionic structure (open ring, stable) to the nonionic structure (closed ring, temporarily stable) [FIG. 6(*b*)].

By the photochemical reaction, the electroconductive varation imparting agent changed to the nonionic structure will no longer act as the trapping agent, and on complete termination of the reaction, the electroconductivity of the photosensitive member will be restored to the electroconductivity inherent in the charge transport material constituting the converting layer.

Accordingly, in this case, when negative corona charging is applied to the surface of the photosensitive member by a charger 51, difference in charging potential based on the difference in dark electroconductivity of the converting layer is created between the exposed portion and the unexposed portion (FIG. 6(*c*)].

Also, when voltage is applied to the surface of the photosensitive member by the use of a contact electrode, a difference in dark current is created, which is due to the difference in electroconductivity between the exposed portion and the unexposed portion.

The state where the electroconductivity variation imparting agent has become nonionic by the photoirradiation exists stably for a long time in a dark place, whereby memorizable electroconductivity variation is exhibited.

The memorizable electroconductivity variation under this state exhibits long memorizability when standing naturally in a dark place, but the electroconductivity variation imparting agent under the ring-closed state returns to the original state of ring-opened state by absorbed light, irradiation, thermal energy such as heating, etc., whereby it again exhibits the trap effect of a hole, thus making possible so-called memorizable erasing [FIG. 6(*d*)].

On the other hand, the memorizable electroconductivity variation imparting agent, when considering the case of increasing electroconductivity of the converting layer by causing structural change from ionic to nonionic structure of the radical state by imparting light energy, is estimated as follows. FIGS. 7(*a*) to (*e*) are conceptional views representing the process in this case. That is, when the charge transport substance is a so-called p-type semiconductor with a great hole mobility, in the converting layer 2 containing the electroconductivity variation imparting agent added in these materials the electroconductivity variation imparting agent functions as the trapping agent of holes and electrons, whereby lowering of the dark electroconductivity is caused to occur. More specifically, into the converting layer 2, holes are injected from the electroconductive substrate 1 by negative corona charging and negative voltage application by the counter-electrode, and the holes are trapped by the anionic portion of the ionic electroconductivity variation imparting agent to be neutralized with formation of radicals [FIG. 7(*b*)]. On the other hand, when a counter-electrode is used, electrons are also injected partially from the counter-electrode, but, since the charge transport substance has a small electron mobility, no significant difference will appear. If the converting layer 2 having such characteristics is irradiated with, for example, light in the absorption wavelength region of the electroconductivity variation imparting agent through a mask 50, electron-hole pairs are formed in the electroconductivity variation imparting agent, and the electron-hole pairs are separated under a high electrical field. The separated electrons are trapped by the cationic portion of the electroconductivity variation imparting agent to be neutralized with formation of radicals [FIG. 7(*c*)].

On the other hand, holes migrate through the charge transport substance under a high electrical field to neutralize negative charges on the converting layer surface, or are injected into the counter-electrode. As the result, the ionic property electroconductivity variation imparting agent disappears through radical formation, will no longer act as the trapping agent of a hole, and on complete termination of the reaction, the electroconductivity of the photosensitive member will be restored to the electroconductivity inherent in the charge transport material constituting the converting layer [FIG. 7(c)]. Also, when such an electroconductivity variation imparting agent forms radicals, not only change in electroconductivity of the converting layer itself is caused to occur, but the radicals formed on the electroconductive substrate surface also increase hole injection from the substrate. However, when the electroconductive substrate is an ohmic substrate, only electroconductivity variation of the converting layer itself occurs because of the absence of rate controlling of hole injection from the substrate.

Figure 7A:
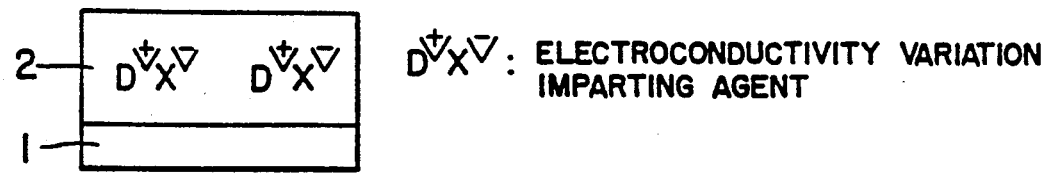
Figure 7B:
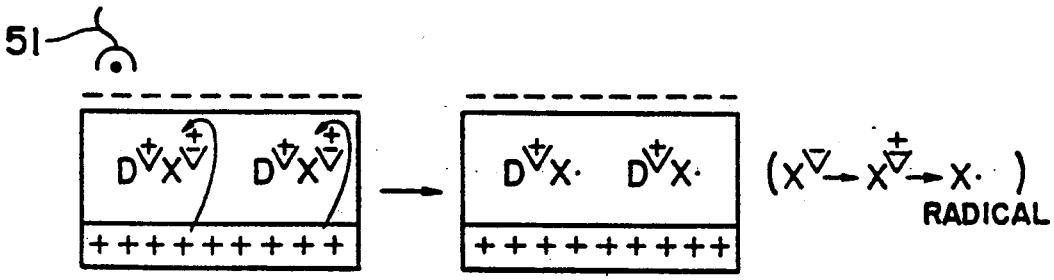
Figure 7C:
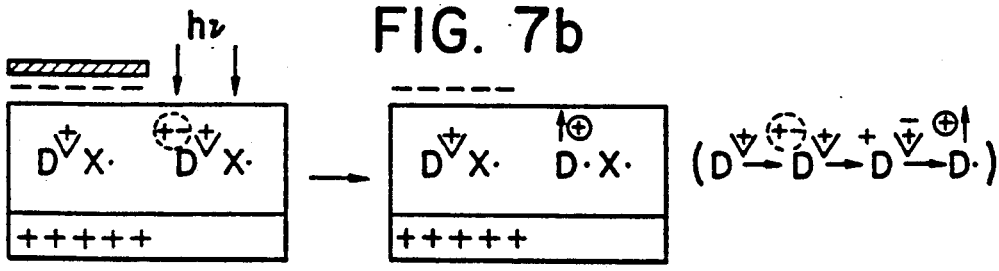
Figure 7D:
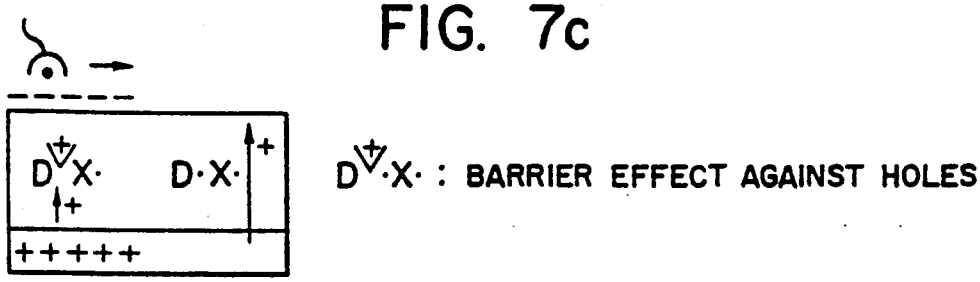
Figure 7E:
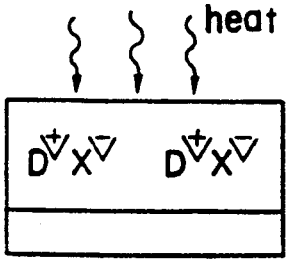

Accordingly, as shown in FIG. 7(d), when negative corona charging is applied to the converting layer surface, difference in charging potential based on the difference in dark electroconductivity of the converting layer is created between the exposed portion and the unexposed portion.

Also, when voltage is applied to the converting layer surface by the use of a counter-electrode, difference in the dark current due to the difference in electroconductivity between the exposed portion and the unexposed portion is created.

The state where the electroconductivity variation imparting agent has become nonionic with radical formation by the photoirradiation exists stably for a long time in a dark place, whereby memorizable electroconductivity variation is exhibited. The memorizable electroconductivity variation under this state exhibits long memorizability when standing naturally in a dark place, but the electroconductivity variation imparting agent under radical state (nonionic) returns to the original state of ionic state by absorbed light, irradiation, thermal energy such as heating, whereby it again exhibits the trap effect of holes, electrons, thus effecting so-called memorizable erasing FIG. 7(e)].

Recording-reading-erasing

Figure 4:
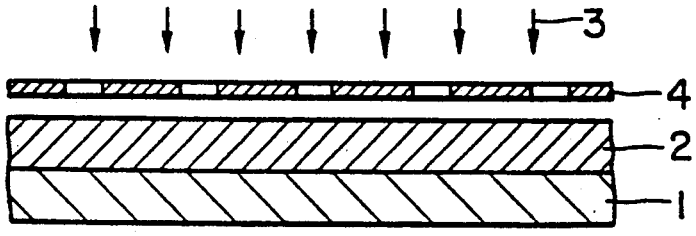
FIG. 4 is a sectional view illustrating the method for using the recording material according to the present invention.

For obtaining a memorizable electroconductivity variation pattern image according to the method of the present invention, as shown in FIG. 4 corresponding to FIG. 1, pattern exposure may be effected on the converting layer 2 by photoirradiation through a transmissive original 4 from the light source 3. When the electrode material 1 is transparent, exposure onto the converting layer 2 can be also effected through the electrode material 1 (not shown). As the light source 3, a continuous spectrum light source such as white lamp, xenon lamp, or halogen lamp can be used. In addition, when the electroconductivity variation imparting agent has light absorption (sensitivity) in the visible region, monochromatic light in the visible region can also be used. Representatives of such monochromatic light are, for example, laser beams such as Ar laser (514 nm), Ruby laser (488 nm), Die laser, and He-Ne laser (633 nm), and in this case, direct pattern exposure can be effected according to the beam operation by utilizing the specific feature of laser which has great energy density per unit area. Also, when the electroconductivity variation imparting agent has light absorption (sensitivity) in the near infrared region, various semiconductor lasers (780 nm, 810 nm, 830 nm) are available.

Also, in the present invention, the converting layer can be subjected once to whole surface exposure by using heat energy, and further to heat energy corresponding to recording information applied on the recording layer to effect thermal recording.

Also, pattern recording is possible, and the converting layer can be subjected once to whole exposure with heat energy, followed by further application of heat energy corresponding to the recording information to effect thermal recording.

As such a recording method, recording can be performed by the use of a heat-sensitive head used in conventional heat-sensitive recording, and also thermal recording by the use of IR-ray laser can be performed. In this case, when the converting layer has no absorption corresponding to IR-ray laser, a system having a UV-ray absorber newly added therein may be used.

In the recording material of the present invention, even without addition of a sensitizer, a good memorizable electroconductivity variation effect can be obtained with an exposure dosage of about 10 to 100 $mJ/cm^2$ by simple exposure, but for further enhancement of sensitivity, charging may be effected before exposure, or exposure may be effected by the application of voltage with an electrode in contact with the converting layer as described in Japanese Patent Application No. 5233/1982, whereby sensitivity is further increased. Also, stability of the memorizable electroconductivity variation obtained will persist for about one week at room temperature, even in the reversible case as described above.

The memorizable electroconductivity variation pattern image obtained as described above is generally a latent image, which can be utilized as an electrostatic photography or electrostatic printing master to obtain a visible image. That is, negative corona discharging is effected on the converting layer having a memorizable electroconductivity variation pattern image thereon to form an electrostatic latent image corresponding to the electroconductive pattern, and thereafter various developing methods or xerography as represented by developing by attachment with toner powder, transfer to paper, etc. can be directly applied. Also, when a memorizable electroconductivity variation image is once obtained according to the method of the present invention, a large number of sheets of copies can be obtained by thereafter repeating charging developing and transfer. Since the electroconductive image and developing can be separated from each other as the method making use of the memorizable electroconductivity variation function, application as the printing plate capable of partial printing can also be expected.

Further, as other embodiments of the information recording method of the present invention, the following methods can be also employed.

(a) Voltage is applied to the converting layer by the use of a contact electrode or an earth electrode, and information recording is performed with light or heat energy under such a state.

(b) Uniform photoirradiation is uniformly effected on the converting layer, and voltage is applied by a pin electrode, a dot electrode, or the like under such a state to effect electrically information recording.

(c) Heat energy is imparted uniformly onto the converting layer, and voltage is applied by a pin electrode, a dot electrode, or the like under such a state to electrically effect information recording.

(d) Voltage application and heating are conducted at the same time on the converting layer by the use of a heat-sensitive head to effect information recording.

According to the method as described above, by simultaneously performing information recording under the state with a voltage applied, the recording sensitivity can be further improved. That is, according to the sensitizing method by corona charging, the electrical field applied to the converting layer under charged state will be lowered with photoirradiation, whereby the sensitizing effect can no longer be obtained under the state where charging has become 0 (zero). In contrast, when photoirradiation is effected simultaneously under the state of voltage being applied externally, the electrical field intensity will not change relative to photoirradiation, whereby a uniform sensitizing effect can be obtained during the period of photoirradiation.

As the electrical method for reacting to the information recorded as described above, although the methods such as electrodeposition developing, electrolytic developing, and electrophoretic developing, can also be utilized by utilizing the difference in memorizable electroconductivity, the method of directly reading the difference in electroconductivity can be effectively used. That is, (a) the method in which voltage is applied by the use of a contact electrode such as a pin electrode on the converting layer after imparting pattern-like light and heat energy, and the difference in current value is detected, or (b) the method in which a device having a sandwich type cell structure having a converting layer provided with a transparent or translucent electrode on one or both of electrodes sandwiched therebetween is constituted, and the difference in current value or the difference in voltage before and after imparting light and heat energy is read can be utilized. As such an electrode, materials capable of giving a stable surface resistivity of $10^2$ to $10^6$ Ω/□, for example, a metal or semiconductor element such as Ti, Au, Ag, Fe, Sn, Cu, or In, or an oxide semiconductor such as $SnO_2$, $In_2O_3$, ZnO, NiO, TiO, WO, or $V_2O_5$ are used singly, or as a composite material. The above method (a) is effective as a method of directly reading the memory pattern image electrically, and the latter method (b) can be utilized as optical switching devices such as optical sensors, etc.

Further, as a specific feature of the recording medium of the present invention, easy memorizable erasing may be mentioned. As the method for memorizable erasing, the method of effecting UV-ray irradiation, or the method for effecting erasing by heating the converting layer with a hot plate, hot rollers, etc., of 100° to 150° C.

According to the method by UV-ray irradiation, there is little thermal damage, and complete erasing of memorizable electroconductivity variation can be effected within about 60 seconds. On the other hand, according to the method by heating, complete erasing becomes possible within only about 1 to 5 seconds under a condition of 120° C. to 150° C.

Non-memorizable converting device

Figure 5:
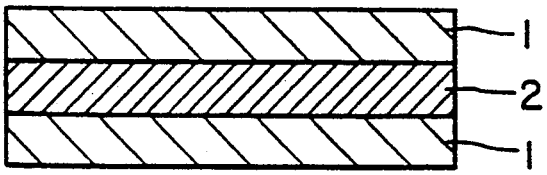
Figure 6A:
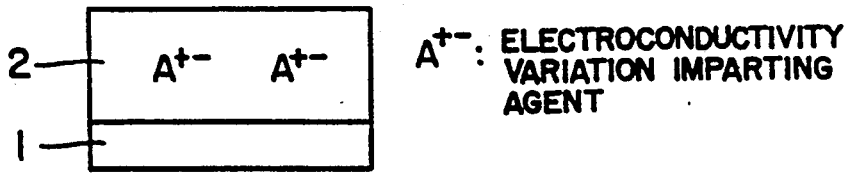
FIG. 6 to FIG. 8 are conceptual views for illustration of the mechanism of information recording.
Figure 6B:
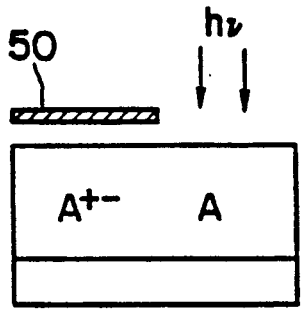
Figure 6C:
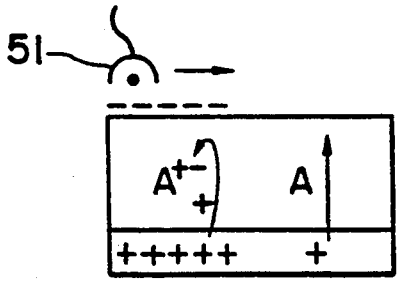
Figure 6D:
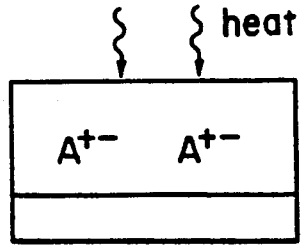

As shown in FIG. 5, a non-memorizable converting device can be constituted by providing a non-memorizable converting layer 2 sandwiched between a pair of electrode materials 1. By forming such a sandwich type cell, it can be applied to a sensor, switching device, etc. For example, when the applied energy is light, it can be utilized as an optical switching device or an optical sensor, while in the case of heat, it can be utilized for thermostats, etc. Furthermore, it is also utilizable as described above, as the electrostatic printing master plate material. However, in such a case, only one of the electrodes is sufficient.

Electrode material

As the electrode material 1, a transparent or translucent electrode material is employed for one or both of the electrodes, and materials capable of giving a stable surface resistivity of $10^2$ to $10^6$ Ω/cm, for example, metal or semiconductor elements such as Au, Zn, Al, Ag, Fe, Sn, Cu, and In, an oxide semiconductor such as $SnO_2$, $In_2O_3$, ZnO, TiO, NiO, WO, or $V_2O_5$ can be used singly or as a composite material of two or more kinds.

Converting layer

The converting layer 2 comprises a material obtained by formulating a charge transport substance and an electroconductivity variation imparting agent.

As the charge transport substance in this case, those of $10^{-3}$ to $10^{18}$ Ω·cm can be employed, and specifically the following substances are preferably used.

For example, as the substance of $10^{17}$ Ω·cm or higher, there are polyvinylcarbazole or low molecular weight photoconductors, and phthalocyanine compounds of $10^{17}$ to $10^{11}$ Ω·cm, polyacetylenes of $10^{11}$ to $10^4$ Ω·cm, perylene compounds of $10^4$ to 10 Ω·cm, TTF-TCNQ complexes of 10 to $10^{-3}$ Ω·cm, etc. can be used.

Particularly, materials obtained by formulating a charge transport substance with a specific resistivity of $10^{-12}$ Ω·cm and a non-memorizable electroconductivity variation imparting agent are preferably used.

The above binder resin can be also added to increase the adhesiveness with the electrode material as well as increasing the film strength.

On the other hand, as the non-memorizable electroconductivity variation imparting agent, of the spiropyrane compounds as mentioned above, those of 61 to 69 can be employed. However, in the compounds of 61 to 69, the substituent X is preferably a halogen.

The above spiropyrane compound is a substance which undergoes reversible structural change between ionic and nonionic structures by the action of light or heat energy, and its change occurs under the state when it is imparted with energy, and returns to the original structure under the state when energy is interrupted.

Detection method

By applying light or heat energy to the converting device, the conversion signal can be detected by detecting electrically the electroconductivity variation in the converting layer caused thereby.

In the following, the present invention is described by referring to Examples, but the present invention is not limited in any way by these Examples.

EXAMPLE 1

| | |
|---|---|
| 1',3',3'-Trimethylspiro[indoline-2,2'-benzopyrane]-6-carboxylic acid (electroconductivity variation imparting agent) | 30 mg |
| Polyvinylcarbazole (charge transport substance: Tubicol produced by Takasago Senryo K.K.) | 1 g |
| Polyester resin (binder: Vyron 200, produced by Toyobo K.K.) | 0.1 g |
| $CHCl_3$ | 20 g |

A mixture having the above composition was prepared in a dark place and applied as a coating on a polyester film having $In_2O_3$-$SnO_2$ vapor deposited thereon (transparent electroconductive polyester film with a surface resistivity of $10^4$ Ω·cm, produced by Teijin K. K.) by means of a doctor blade and dried in air at 60° C. for about 1 hour to obtain a recording material having a converting layer with a film thickness of about 10 μm. For this recording layer, for the purpose of effecting complete drying, natural drying was further performed for one day, and thereafter the following measurements were conducted according to the pattern image forming method of the present invention.

That is, exposure was effected by taking out the light of 560 nm which is the absorption wavelength of the spiropyrane compound (0.1 mW/cm$^2$) by the use of an interference filter and a halogen lamp to effect whole surface electroconductivity treatment of the converting layer. At this time, the surface potential before and after exposure was measured by a corona charger (rotary system paper analyzer, produced by Kawaguchi Denki K. K.).

As a result, the recording material with (−)1500 V receptive potential became (−)700 V charge receptive after an exposure dosage of 560 nm, 10 mJ/cm$^2$ was applied, whereby the contrast potential between the exposed portion and the unexposed portion became −800 V. The state of lowered charge receptivity thus obtained was very stable in the dark state and, even after natural standing in a dark place for 3 days, it was restored to only (−)800 V, and a contrast potential of −700 V was obtained even at this stage.

Contact exposure was effected separately for the converting layer through a pattern film, and toner developing was then performed with (−) corona charging and wet toner for electrophotography of the positive polarity to obtain a toner image at the unexposed portion of the recording material surface. The resolution obtained was 20 lines/mm.

EXAMPLE 2

In the same recording material as used in Example 1, negative charging was effected previously before exposure, and exposure was then effected. In this case, a contrast potential to the same extent as in Example 1 was obtained at an exposure dosage of 1 mJ/cm$^2$ (560 nm) to produce a sensitizing effect.

COMPARATIVE EXAMPLE

In the recording material used in Example 1, the electroconductive substrate was changed to Al-vapor deposited Mylar film in place of the $In_2O_3$-$SnO_2$ transparent electroconductive film. As a result, no lowering of the charge receptivity after exposure was recognized, and no memorizable electroconductivity variation effect was obtained.

EXAMPLE 3

In the recording material used in Example 1, the converting layer surface before and after exposure (exposure: 560 nm, 10 mJ/cm$^2$) was brought into contact with a pin electrode (1 mmϕ). A voltage of 100 V (negative electrode on the pin electrode side) was applied, and the current flowing through the converting layer was measured. As a result, as shown below, a difference in the current value of more than 2 ciphers arose, whereby the difference between the exposed portion and the unexposed portion could be detected without passing through developing processing.

Before exposure: $2\times10^{-12}$ A/cm$^2$
After exposure: $5\times10^{-9}$ A/cm$^2$

EXAMPLE 4

On the converting layer surface of the recording material in Example 1, an Au electrode was vapor deposited to about 500 Å (translucent) with an area of 0.5 cm$^2$ to prepare a sandwich type cell. Between both electrodes were connected in series a direct voltage power source and an ammeter, and the dark current during application of 10 V voltage (positive on the Au electrode side) before and after exposure (560 nm, 10 mJ/cm$^2$) was measured. The results indicated that the dark current after exposure increased by more than 1 cipher as shown below, and therefore it was understood that the device could be used as an optical switching device.

Before exposure: $1\times10^{-11}$ A/cm$^2$
After exposure: $3\times10^{-9}$ A/cm$^2$

EXAMPLE 5

In the memorizable sandwich type optical cell used in Example 4, to the cell after exposure was applied UV-rays (0.1 mW/cm$^2$, 365 nm) at 10 mJ/cm$^2$. As a result, the current value returned to that before exposure (10 V during application), thus effecting memorizable erasing.

EXAMPLE 6

| | |
|---|---|
| 1,3,3-Trismethylspiro[indoline-2,2'-benzopyrane]-8'-carboxylic acid | 30 mg |
| Hydrazone[$(C_2H_5)_2NC_6H_5CH{=}NN(C_6H_5)_2$] | 1 g |
| Polyester resin (Vyron 200, produced by Toyobo K.K.) | 1 g |
| $CHCl_3$ | 23 g |

A mixture having the above composition was applied by using a Myer bar on an NiO substrate having a surface resistivity of about $10^4$ Ω·cm and completely dried to form a converting layer with a film thickness of about 10 μm. After exposure of 540 nm, 10 mJ/cm$^2$ was effected on the converting layer of the recording material obtained, it was dipped in a wet toner for electrophotography of negative polarity, and a direct current of 100 V was applied between an aluminum plate as the counterelectrode and the photosensitive substrate. As a result, the toner adhered to the exposed portion to confirm that electrodeposition was effected.

EXAMPLE 7

| | |
|---|---|
| 6-Nitro-1',3',3'-trimethylspiro[2H-benzopyrane-2,2'-indoline] | 50 mg |
| Triphenylamine[$N(C_6H_4CH_3)_3$] | 1 g |
| Polycarbonate resin (binder: Panlite 1350, produced by Teijin Kagaku) | 0.1 g |
| $CHCl_3$ | 20 g |

A mixture having the above composition was prepared in a dark place and applied as a coating onto the same substrate as in Example 1 (film thickness 10 μm). As a result of effecting UV-ray irradiation (365 nm) at 1 mJ/cm$^2$ on the recording material obtained, the surface potential after exposure was increased from −900 V to −1400 V, and a contrast potential of −500 V was obtained between the exposed portion and the unexposed portion. This state was found to be stable under the dark state, and no change was seen even after it was left to stand for 3 days. However, as the result of exposure to a light with a wavelength of 600 nm at 10 mJ/cm$^2$, it returned to the original state (surface potential = −900 V), thus effecting memorizable erasing.

EXAMPLE 8

| | |
|---|---|
| 6-Chloro-8-nitro-1',3',3'-trimethylspiro-(2H-1-benzopyrane-2,2'-indoline] | 40 g |
| Polyvinylcarbazole ethyl acrylate (produced by Takasago Kogyo K.K.) | 1 g |
| Polyester resin (binder: Vyron 200, produced by Toyobo K.K.) | 0.2 g |
| $CHCl_3$ | 25 g |

A mixture having the above composition was prepared in a dark place and applied as a coating onto the same substrate as in Example 1. By the use of the recording material having a converting layer with a film thickness of about 10 μm obtained, whole surface UV-ray irradiation was effected at 10 mJ/cm$^2$, followed by printing recording by means of a heat-sensitive head (application voltage 8 V). The recording material was then subjected to (−) corona charging under the dark state, subsequently toner developing under a bias voltage of −800 V, and toner transfer, respectively, whereby toner printing recording could be effected onto plain paper.

In this case, toner developing was effected at the unheated portion.

EXAMPLE 9

| | |
|---|---|
| 6-Bromo-1',3',3'-trimethyl[2H-benzopyrane-2,2'-indoline] | 100 mg |
| Pyrazoline[$C_6H_5CHCH_2(C_6H_5N_2C)CHCHC_6H_5$] | 1 mg |
| Polyester resin | 0.1 g |
| Tetrahydrofuran | 24 g |

A mixture having the above composition was applied as a coating onto an ITO substrate in the same manner as in Example 1 to prepare a recording material.

This recording material had a charging potential of (−)650 V, but as the result of heating on a hot plate at 150° C. for 10 seconds, the charging potential was increased to (−)1000 V, whereby a contrast potential (−)350 V could be obtained to find that heat-sensitive recording could be done. The state was stable for longer than one day at room temperature.

The difference between the heated portion and the unheated portion could be made visual by conventional toner developing.

The recording material under the heated state was the color-formed state having an absorption peak around 600 nm, and as a result of applying light with a wavelength at 100 mJ/cm$^2$, it returned to the original state (uncolored state) to indicate that it is reversible.

EXAMPLE 10

When 3,3'-dimethyl-5'-methacrylamino-6-nitrospiro[-2H-1-benzothiazoline] was used in place of the spiropyrane compound in Example 9, the charging potential before and after heating at 150° C. for 10 seconds changed from (−)800 V to (−)1200 V to obtain the same characteristic as in Example 9. Then, as a result of performing exposure at 100 mJ/cm$^2$ with light of a wavelength of 550 nm, the state returned to its original state.

EXAMPLE 11

| | |
|---|---|
| p-Diazo-N,N-dimethylaniline | 15 mg |
| Polyvinyl carbazole | 1 g |
| Polyester resin | 0.1 g |
| Toluene | 19 g |

A material having the above composition was coated onto an ITO substrate in the same manner as in Example 1 to prepare a recording material.

The charging potential of this recording material was (−)500 V, but it was reduced to (−)200 V when UV-rays of 365 nm were applied at 30 mJ/cm$^2$, and this state was irreversible in a dark place to obtain a permanent electroconductivity variation.

EXAMPLE 12

| | |
|---|---|
| Tri(N-dimethylaminophenyl)methane (electroconductivity variation imparting substance 1) | 10 mg |
| 2-Chloroanthraquinone (electroconductivity variation imparting substance 2) | 10 mg |
| Oxadiazole[$(C_2H_5)_2NC_6H_5CNNOCC_6H_5N(C_2H_5)_2$] (charge transport substance) | 1 g |
| Polyester resin (binder: Vyron 200 produced by Toyobo) | 0.1 g |
| Dichloroethane | 24 g |

A material having the above composition was coated onto an ITO substrate in the same manner as in Example 1 to prepare a recording material.

The charging potential of this recording material was (−)300 V, but it was increased to (−)650 V when UV-ray of 365 nm was applied at 10 mJ/cm$^2$, and state was irreversible in a dark place to produce a permanent electroconductivity variation.

EXAMPLE 13

A mixture with the composition of Example 1 was applied to an ITO substrate ($10^4$ Ω/□) by means of a doctor blade to obtain a converting layer with a film thickness of 2 μm.

On the layer was further coated a mixture having the composition shown below by means of a spinner to laminate a charge transport layer of 10 μm.

| | |
|---|---|
| Hydrazone [$(C_2H_5)_2NC_6H_5CH{=}NN(C_6H_5)_2$] (charge transport substance) | 1 g |
| Polycarbonate (binder) | 1 g |
| Toluene | 20 g |

Measurement was conducted after the lamination type recording material was dried in the same manner as in Example 1.

As a result, the recording material having a receptive potential of (−)1,500 V before exposure was given a receptive potential of (−)700 V by charging exposure (560 nm) at an exposure dosage of 0.5 mJ/cm$^2$, thus obtaining a sensitizing effect as compared with Example 2.

EXAMPLE 14

| | |
|---|---|
| Spiropyrane (the above compound 61 wherein X = Br) | 0.1 g |
| Perylene | 1 g |
| Polycarbonate (produced by Teijin Kagaku, Panlite 1350) | 0.5 g |
| Chlorobenzene | 20 g |

A mixture having the above composition was coated onto a Cu substrate (film thickness 10 μm), and further an Au electrode was vapor deposited (500 Å) to prepare a sandwich type cell (0.1 $cm^2$ area). The sandwich cell, under the dark state during application of 10 V voltage ($10^4$ V/cm) permitted $5\times10^{-5}$ A/$cm^2$ of current to flow therethrough, but during voltage application under the state irradiated with UV-rays (365 nm, 0.1 mV/$cm^2$), the current value was reduced to $2\times10^{-8}$ A/$cm^2$. Further, when photoirradiation was stopped, the current value instantly returned to the original value. It was thus found to be useful as an optical switching device.

The change in current value of ON, OFF states of photo-irradiation has a difference in current value greater by 2 ciphers or more as compared with the change in current value as compared with the case when a conventional electrophotographic material is used as the sandwich type cell (i.e. less current change for electrophotographic material), thus being fundamentally different.

EXAMPLE 15

| | |
|---|---|
| Spiropyrane (the above compound 68 wherein X = Br) | 0.3 g |
| Perylene | 1 g |
| Polyester resin (Vyron 200, produced by Toyobo) | 0.5 g |
| Chloroform | 20 g |

A mixture having the above composition was coated onto an Ag substrate (film thickness 10 μm), and further an Au electrode was vapor deposited to prepare a sandwich type cell (0.1 $cm^2$ area). The sandwich cell, under the dark state during application of 10 V voltage permitted $1\times10^{-7}$ A/$cm^2$ of current to flow therethrough, but during voltage application, the current value was reduced to $2\times10^{-7}$ A/$cm^2$ simultaneously with irradiation of UV-rays (365 nm/1 mV/$cm^2$) from the Au electrode side. Further, it returned to the original current value after the photoirradiation was stopped. The sandwich cell was therefore found to be useful as the photosensor of UV-rays.

The change in current value of ON, OFF states of photoirradiation is higher in current change range as compared with photocurrent and dark current conventionally observed in electrophotographic materials. It is therefore a fundamentally different phenomenon.

EXAMPLE 16

| | |
|---|---|
| Spiropyrane (the above compound 68 wherein X = Cl) | 0.5 g |
| TCNQ (tetracyanoquinodimethane) | 1.0 g |
| TTF (tetrathiafluvalene) | 1.0 g |
| Polyester resin (Vyron 200, produced by Toyobo) | 0.2 g |

-continued

| | |
|---|---|
| Chlorobenzene | 20 g |

A mixture having the above composition was coated an Au substrate (film thickness = 10 μm), and further an Au electrode was vapor deposited (500 Å) to prepare a sandwich type cell (0.1 $cm^2$ area). The sandwich cell, under the state during 10 V voltage application, permitted $10^{-4}$ A/$cm^2$ of current to flow therethrough, but the current value was reduced with heating, becoming $5\times10^{-5}$ A/$cm^2$ at 40° C., $2\times10^{-6}$ A/$cm^2$ at 60° C. and $8\times10^{-7}$ A/$cm^2$ at 80° C. After the heating was stopped, the current value returned to the original value with a decrease of temperature. Thus, the sandwich cell was found to be useful as a thermostat.

EXAMPLE 17

| | |
|---|---|
| Spiropyrane (the above compound 12 wherein 6-position is COOH) | 0.1 g |
| Copper phthalocyanine | 1 g |
| Polyester resin (Vyron 200, produced by Toyobo) | 0.5 g |
| Toluene | 10 g |

A mixture having the above composition was coated onto a Cu substrate (film thickness 8 μm), and further an Au electrode was vapor deposited thereon (500 Å) to prepare a sandwich type cell. The sandwich cell, a 100 V constant voltage power source and a 100 KΩ standard resistance were connected in series to form a circuit.

Before irradiation of UV-rays on the sandwich type cell, the voltanoic meter connected between both ends of the standard resistance exhibited 10 V under the state of 100 V voltage application, but the voltage of the voltanoic meter after irradiation of 10 mJ/$cm^2$ of UV-rays (0.1 mW/$cm^2$, 365 nm) was reduced to 0.1 V. Thus, the electroconductivity variation of the sandwich type cell was detected as the difference in voltage.

This state was stable in a dark place for 5 hours, but it returned to the original state after irradiation of 540 nm (0.3 mW/$cm^2$) at 50 mJ/$cm^2$, and repeated use was possible.

For example, in the sandwich type cell known in the art, the photoelectric converting characteristics described in SPSE (Society of Photographic Science and Engineering), Vol. 26, No. 3, 143 (1982) are as follows.

Cell constitution: Au/PVK 4CNB/$In_2O_3$ $SnO_2$ (ITO)

Here, CNB is $C_6H_5(CN)_4$

Photocurrent value: $10^{-10}$ A/$cm^2$ (Field: $1\times10^4$ V/cm)

Dark current: $10^{-12}$ A/$cm^2$ (Field: the same as above)

EXAMPLE 18

| | |
|---|---|
| Sodium 1',3',3'-trimethylspiro[indoline-2,2'-benzopyrane]hexacarbonate | 9 g |
| 3,6-dibromo-polyvinyl carbazole | 3 g |

The above compounds were mixed and dissolved in THF (tetrahydrofuran solvent), and further the mixture was refluxed for 3 hours. After being cooled to room temperature, the solution was mixed into cyclohexane, whereby precipitates of deep green color were obtained.

The precipitates were then dissolved in chloroform and the solution was again mixed into cyclohexane to effect reprecipitation. These operations were repeated 3 times.

The substance obtained may be considered to have the structure (A) shown below, and no peak of bromine was seen from the IR spectrum of this substance.

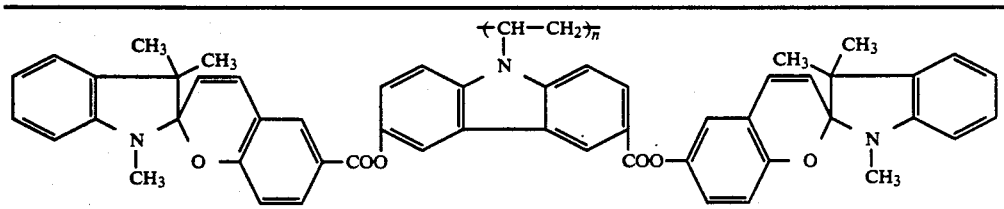

(A)

| | |
|---|---|
| Compound (A) | 1 g |
| Polyester resin (Vyron 200, produced by Toyobo) | 0.1 g |
| $CHCl_3$ | 20 g |

Next, a mixture having the above composition was prepared in a dark place and coated onto a polyester film having Au vapor deposited thereon by means of a doctor blade, which step was followed by drying in air at 60° C. for one hour to form a converting layer with a thickness of about 10 μm, thus obtaining a recording material.

As the result of measurement according to the same method as in Example 1, the recording material with a receptive potential of (−)1200 V before exposure was reduced to have a receptive potential of (−)400 V after exposure (540 nm, 10 mJ/cm$^2$), whereby the contrast potential between the exposed portion and the unexposed portion became (−)800 V.

The state of the lowered charge receptivity obtained was found to be stable under the dark state, and even after being left to stand for 2 days, it was restored to only (−)600 V, thus giving a contrast potential of (−)600 V.

EXAMPLE 19

| | |
|---|---|
| 1',3',3'-Trimethylspiro[indoline-2,2'-benzopyrane]hexacarboxylic acid (electroconductivity variation imparting agent) | 30 mg |
| Poly[vinylnaphthalene] P-CA (charge transport substance) | 1 g |
| Polyester resin (binder: Vyron 200, produced by Toyobo K.K. | 0.1 g |
| $CHCl_3$ | 15 g |

A mixture having the above composition was prepared in a dark place and coated onto a polyester film having Au vapor deposited thereon by using a doctor blade, which step was followed by drying using air at 60° C. to obtain a recording material having a converting layer with a thickness of about 10 μm. For this recording material, in order to effect complete drying, it was further subjected to natural drying, and thereafter according to the pattern image forming method of the present invention, the following measurements were conducted.

That is, exposure was effected by taking out light of 560 nm (0.1 mJ/cm$^2$) which is the absorption wavelength of the spiropyrane compound by means of an interference filter and a halogen lamp to effect electroconductivity treatment of the whole surface of the converting layer. At this time, the surface potential before and after exposure was measured by a corona charger (rotary system paper analyzer, produced by Kawaguchi Denki K. K.).

As a result, the recording material with a receptive potential of (−)800 V before exposure had a charge receptivity of (−)200 V after an exposure dosage of 560 nm, 10 mJ/cm$^2$ was applied, and the contrast potential between the exposed portion and the unexposed portion became −600 V. The state of the lowered charge receptivity thus obtained was restored only to (−)300 V even after it was left to stand in a dark place for 3 days, and a contrast potential of (−)500 V was obtained even at this stage.

EXAMPLE 20

| | |
|---|---|
| P-Diazo-N,N-dimethylaniline (electroconductivity variation imparting agent) | 15 mg |
| Poly(vinylmesitylene)TCNE (charge transport substance) | 1 g |
| Polyester resin (binder: Vyron 200) | 0.1 g |
| $CHCl_3$ | 20 g |

The material having the above composition was coated onto an Au substrate in the same manner as in Example 19 to prepare a recording material.

The charging potential of this recording material was (−)400 V, which was reduced to (−)200 V after UV-rays of 365 nm were applied at 30 mJ/cm$^2$. This state was irreversible in a dark place, thus producing a permanent electroconductivity variation.

EXAMPLE 21

| | |
|---|---|
| Tri(N-diethylaminophenyl)methane (electroconductivity variation imparting agent 1) | 20 mg |
| 2-Chloroanthraquinone (electroconductivity variation imparting agent 2) | 20 mg |
| Poly(vinylnaphthalene)TCNE | 1 g |
| Polycarbonate (Panlite, binder) | 0.1 g |

The material having the above composition was coated onto an Au substrate in the same manner as in Example 19 to prepare a recording material.

The charging potential of this recording material was (−)600 V, which was increased to (−)1,000 V after UV-rays of 365 nm were applied at 10 mJ/cm$^2$ and this state was irreversible in a dark place, thus producing a permanent electroconductivity variation.

EXAMPLE 22

| | |
|---|---|
| 6-Nitro-1',3',3'-trimethylspiro[2H-benzopyrane-2,2'-indoline] (electroconductivity variation imparting agent) | 50 mg |
| Poly(vinylanthracene) TNB (charge transport substance) | 1 g |
| Polyester resin (Vyron 200) | 0.1 g |
| $CHCl_3$ | 24 g |

The material having the above composition was coated onto an Au substrate in the same manner as in Example 19 to prepare a recording material (film thickness 10 μm). The charging potential of this recording material was (−)200 V, and as a result of UV-ray irradiation (365 nm) at 1 mJ/cm², the surface potential after exposure was restored to (−)800 V. This state was not changed at all even after the material was left to stand in a dark place for 3 days. However, as a result of exposure at 10 mJ/cm² of light with a wavelength of 600 nm thereafter, it returned to the original state, thus effecting memorizable erasing.

EXAMPLE 23

| | |
|---|---|
| Spiropyrane (the above compound 66 wherein X is Br) | 0.5 g |
| Polystyrene $AgClO_4$ | 1 g |
| Polycarbonate (Panlite 1350, produced by Teijin Kagaku) | 0.1 g |
| Chlorobenzene | 20 g |

A mixture having the above composition was coated onto an Au substrate (10 μm), and further an Au electrode was vapor deposited (500 Å) to prepare a sandwich cell (0.1 cm² area). The sandwich cell permitted $1\times10^{-5}$ A/cm² of current to pass therethrough under dark condition during application of 10 V voltage application ($10^4$ V/cm), but the current value was reduced to $2\times10^{-8}$ A/cm² under the state of having been irradiated with UV-rays (365 nm, 0.1 mJ/cm²). Further, as a result of stopping photoirradiation, it was instantly restored to the original current value. Thus, the device was found to be useful as an optical switching device.

EXAMPLE 24

On the converting layer surface of the recording material in Example 19, an Au electrode was vapor deposited to about 500 Å (translucent) with an area of 0.5 cm² according to the vacuum vapor deposition method to prepare a sandwich type cell. Between both electrodes, a direct current voltage power source and an ammeter were connected in series, and the dark current during application of 10 V before and after exposure (560 nm, 10 mJ/cm²) was measured. As a result, the dark current after exposure was found to have increased by more than 1 cipher, thus indicating that it can be used as an optical switching device.

Before exposure: $2\times10^{-11}$ A/cm²

After exposure: $3\times10^{-9}$ A/cm²

EXAMPLE 25

| | |
|---|---|
| 6-Bromo-1',3',3'-trimethylspiro[2H-1-benzopyrane-2,2'-indoline] | 50 mg |
| [Polydimethylaminostyrene] CA | 1 g |
| Polyester resin | 0.2 g |

-continued

| | |
|---|---|
| $CHCl_3$ | 24 g |

A mixture having the above composition was prepared in a dark place, coated onto an Au substrate in the same manner as in Example 19 to prepare a recording material having a converting layer with a film thickness of 10 μm.

The charging potential of this recording material was (−)400 V, but as a result of heatintg at 150° C. for 10 seconds by means of a hot plate, the charging potential was restored to (−)1,000 V, to obtain a contrast potential of (−)600 V. This state was stable for one day or longer at room temperature, but when light of 600 nm was applied at 100 mJ/cm² thereafter, it returned to the original state reversibly.

EXAMPLE 26

| | |
|---|---|
| Auramine [$(CH_3)_2NC_6H_4C(NH_2)C_6H_4N^+(CH_3)_2BF_4^-$] (diarylmethane type) | 0.3 mg |
| Polyvinylcarbazole | 1 g |
| Polyester resin (Vyron 200, produced by Toyobo) | 0.1 g |
| $CHCl_3$ | 24 g |

A mixture having the above composition was prepared in a dark place and coated onto an ITO substrate in the same manner as in Example 1 to prepare a recording material having a converting layer with a film thickness of 10 μm. The charging potential of this recording material was (−)1,000 V, and after (−) charging, light of 500 nm was applied at 500 erg/cm², which step was followed by (−) charging. As a result, the charging potential was reduced to (−)200 V. This state was restored to only (−)400 V even after 2 days at room temperature, whereby a contrast potential of (−)600 V was obtained. However, this state returned to the original state by heating at 150° C. for 3 seconds, thus effecting memorizable erasing.

EXAMPLE 27

| | |
|---|---|
| Rhodamine B [$(C_2H_5)_2NC_6H_3OC_6H_4COOHCC_6H_3N^+(C_2H_5)_2BF_4^-$] (xanthene type) | 0.4 mg |
| Polyvinylcarbazole | 1 g |
| Polyester resin (Vyron 200, produced by Toyobo K.K.) | 0.1 g |
| $CHCl_3$ | 20 g |

A mixture having the above composition was prepared in a dark place and coated onto an ITO substrate in the same manner as in Example 1 to prepare a recording material having a converting layer with a thickness of 10 μm. The charging potential of this recording material was (−)1,100 V, and after (−) charging, light of 560 nm was applied at 400 erg/cm², which step was followed again by (−) charging. As a result, it was reduced to (−)400 V. This state was restored to only (−)600 V even after the material was left to stand at room temperature for 3 days, whereby a contrast potential of (−)500 V was obtained. However, this state returned to the original state by heating at 150° C. for 2 seconds, thus effecting memorizable erasing.

EXAMPLE 28

| | |
|---|---|
| Methylene blue [$(CH_3)_2N(C_6H_3)SN(C_6H_3)N^+$ $(CH_3)_2BV_4-$] (thiazine type) | 0.1 mg |
| Oxadiazole | 1 g |
| Polyester resin | 1 g |
| $CHCl_3$ | 24 g |

A mixture having the above composition was prepared in a dark place and coated onto an ITO substrate in the same manner as in Example 1 to prepare a recording material having a converting layer with a thickness of 10 μm. The charging potential of this recording material was (−)900 V, and after (−) charging, light of 600 nm was applied at 200 erg/cm$^2$, which step was followed again by (−) charging. As a result, it was reduced to (−)100 V. This state was restored to only (−)300 V even after the material was left to stand at room temperature for 4 days, whereby a contrast potential of (−)600 V was obtained. However, this state returned to the original state by heating at 140° C. for 5 seconds, thus effecting memorizable erasing.

EXAMPLE 29

| | |
|---|---|
| Crystal violet [$(CH_3)_2NC_6H_4)_2CC_6H_4N^+$ $(CH_3)_2BF_4^-$] (triarylmethane type) | 0.3 mg |
| Poly[vinylnaphthalene] P-CA | 1 g |
| Polyester resin | 0.1 g |
| $CHCl_3$ | 20 g |

A mixture having the above composition was prepared in a dark place and coated onto an ITO substrate in the same manner as in Example 19 to prepare a recording material having a converting layer with a thickness of 10 μm. The charging potential of this recording material was (−)700 V, and after (−) charging, light of 610 nm was applied at 1,000 erg/cm$^2$, which step was followed again by (−) charging. As a result, it was reduced to (−)100 V. This state was restored to only (−)200 V even after the material was left to stand at room temperature for 2 days, whereby a contrast potential of (−)500 V was obtained.

EXAMPLE 30

| | |
|---|---|
| Thioflavine T [$CH_3C_6H_3SN^+CH_3C_6H_4N$ $(CH_3)_2BV_4^-$] (thiazole type) | 0.4 mg |
| Poly(vinylmesitylene) TCNE | 1 g |
| Polyester resin (binder: Vyron 200) | 0.1 g |
| Monochlorobenzene | 15 g |
| $CHCl_3$ | 20 g |

A mixture having the above composition was prepared in a dark place and coated onto an ITO substrate in the same manner as in Example 19 to prepare a recording material having a converting layer with a thickness of 10 μm. The charging potential of this recording material was (−)500 V, and after (−) charging, light of 500 nm was applied at 400 erg/cm$^2$. As a result, it was reduced to (−)50 V. This state was restored to only (−)100 V even after the material was left to stand at room temperature for 4 days, whereby a contrast potential of (−)400 V was obtained. However, this state returned to the original state upon heating at 150° C. for 1 second, thus effecting memorizable erasing.

EXAMPLE 31

In the recording material in Example 26, the recording method was changed to charging-exposure to uniformly apply light of 0.1 mW/cm$^2$, 500 nm. Under this state, recording was performed with application of (−)100 V voltage by a pin electrode, whereby recording could be effected with the charging potentials at the non-voltage application portion, the voltage application portion being (−)900 V and (−)300 V, respectively.

EXAMPLE 32

In the recording material in Example 26, the recording method was changed to charging-exposure and light of 500 nm, 100 erg/cm$^2$ was applied while (−)200 V was applied by means of a contact electrode. As a result, recording could be effected with the charging potentials at the unexposed portion and the exposed portion becoming (−)1,000 V and (−)200 V, respectively.

EXAMPLE 33

In the recording material in Example 9, the recording method was changed to single heating, and voltage application and heating were conducted at the same time by the use of a heat-sensitive head (application voltage −8 V), whereby the same recording could be done with a heating time of 100 ms.

EXAMPLE 34

In the recording material in Example 9, the recording method was changed to single heating, and under the state where the recording material was heated uniformly to 800° C., a voltage of (−)100 V was applied by means of a pin electrode. As a result, recording could be effected with the charging potentials at the voltage applied portion, the non-applied portion becoming (−)900 V and (−)650 V, respectively.

EXAMPLE 35

In the recording material in Example 19, the recording method was changed to charging-exposure, and light of 0.1 mV, 560 nm was applied uniformly. Under this state, recording was performed with partial application of a voltage of (−)100 V by a pin electrode. As a result, recording could be effected, with the charging potentials at the non-voltage applied portion and the voltage applied portion becoming (−)800 V and (−)400 V, respectively.

EXAMPLE 36

In the recording material in Example 25, the recording method was changed to single heating, and voltage application was conducted at the same time by means of a heat-sensitive head (application voltage −10 V) to produce the result that the same recording could be effected with a heating time of one second.

EXAMPLE 37

In the recording material in Example 25, the recording method was changed to single heating, and, under the state of the recording material being heated to 70° C., a voltage of (−)100 V was applied by a pin electrode. As a result, recording could be effected, with the charging potentials at the voltage applied portion and the non-applied portion becoming (−)800 V and (−)400 V, respectively.

EXAMPLE 38

In the recording material in Example 19, the recording method was changed to charging-exposure, and, while applying (−)200 V by a contact electrode, light of 560 nm, 1,000 erg/cm$^2$ was applied. As a result, recording could be effected, with the charging potentials at the unexposed portion and the exposed portion becoming (−)800 V and (−)400 V, respectively.

INDUSTRIAL APPLICABILITY

The present invention, as also understood from the results of the above Examples, has the following effects.

(a) In the case when the variable electroconductivity material is memorizable, the memory stability of recording information is markedly improved together with the recording sensitivity.

(b) In the case when the variable electroconductivity material is non-memorizable, excellent photo-(heat-)electric converting characteristics can be obtained.

Accordingly, the variable electroconductivity material of the present invention can be broadly utilized as a material for a diversity of information recording media and various conversion devices.

We claim:

1. A recording material comprising an electrically conductive electrode material and a memorizable converting layer comprising a variable electroconductivity material exhibiting electronic charge conduction, said memorizable converting layer being formed on said electrically conductive electrode material, wherein said variable electroconductivity material comprises:

(a) an electroconductivity variation imparting agent which changes its ionic structure when exposed to light or heat energy, reversibility or irreversibly between nonionic and ionic structures, said electroconductivity variation imparting agent comprising at least one component selected from the group consisting of spiropyrane compounds, diazonium compounds, derivatives thereof, a mixture of a leuco dye and a halide compound, and an ionic dye; and (b) a charge transport substance, the electroconductivity of which varies in relation to the ionic structural change of said electroconductivity variation imparting agent, said charge transport substance comprising at least one component selected from the group consisting of an organic or inorganic charge transport material, a $\pi$-electron conjugated polymer, and a charge-transfer complex compound.

2. The recording material of claim 1, wherein said charge transport substances comprises an organic compound or an inorganic compound having a specific resistivity of $10^{-5}$ to $10^{18}$ Ω·cm.

3. The recording material of claim 1, wherein said electroconductivity variation imparting agent is present in an amount of 0.0001–1 mole per mole of charge transport substance.

4. The recording material of claim 1, further comprising an electroconductive layer superposed on a surface of said memorizable converting layer so as to form a sandwich-like construction.

5. The recording material of claim 1, wherein information is electrostatically recorded on said recording material.

6. A recording material comprising an electrically conductive electrode material and a memorizable converting layer comprising a variable electroconductivity material exhibiting electronic charge conduction, said memorizable converting layer wherein said variable electroconductivity material comprises:

(a) an electroconductivity variation imparting agent which changes its ionic structure when exposed to light or heat energy, reversibly or irreversibly between nonionic and ionic structures, said electroconductivity variation imparting agent comprising at least one dye selected from the group consisting of diarylmethane, triarylmethane, thiazole, methine, xanthene, oxazine, thiazine, azine, acridine, azo and metal complex dyes; and (b) a charge transport substance, the electroconductivity of which varies in relation to the ionic structural change of said electroconductivity variation imparting agent, said charge transport substance comprising at least one component selected from the group consisting of an organic or inorganic charge transport material, a $\pi$-electron conjugated polymer, and a charge-transfer complex compound.

7. The recording material of claim 6, wherein said charge transport substance comprises an organic compound or an inorganic compound having a specific resistivity of $10^{-5}$ to $10^{18}$ Ω·cm.

8. The recording material of claim 6, wherein said electroconductivity variation imparting agent is present in an amount of 0.000–1 mole per mole of charge transport substance.

9. The recording material of claim 6, further comprising an electroconductive layer superposed on a surface of said memorizable converting layer so as to form a sandwich-like construction.

10. The recording material of claim 6, wherein information is electrostatically recorded on said recording material.

* * * * *